US005288683A

United States Patent [19]

Nakashima et al.

[11] Patent Number: 5,288,683

[45] Date of Patent: Feb. 22, 1994

[54] WEAR-RESISTANT COPPER ALLOYS AND SYNCHRONIZER RINGS FOR AUTOMOBILES COMPRISING THE SAME

[75] Inventors: Kunio Nakashima; Masao Hosoda; Kazuyuki Inagaki, all of Toyama, Japan

[73] Assignee: Chuetsu Metal Works Co., Ltd., Toyama, Japan

[21] Appl. No.: 970,709

[22] Filed: Nov. 3, 1992

Related U.S. Application Data

[63] Continuation-in-part of Ser. No. 605,957, Oct. 30, 1990, abandoned.

[51] Int. Cl.[5] ..... C22C 9/04

[52] U.S. Cl. ..... 148/413; 148/414; 420/479; 420/481; 420/484; 420/486; 192/107 M

[58] Field of Search ..... 420/479, 481, 484, 486–489; 148/413, 414; 192/107 M

[56] References Cited

U.S. PATENT DOCUMENTS

| | | | |
|---|---|---|---|
| 4,148,635 | 4/1979 | Smith | 420/479 |
| 4,874,439 | 10/1989 | Akutsu | 420/478 |
| 4,965,045 | 10/1993 | Giarda et al. | 420/478 |
| 4,995,924 | 2/1991 | Akursu | 420/471 |

FOREIGN PATENT DOCUMENTS

| | | | |
|---|---|---|---|
| 60-86237 | 5/1985 | Japan | 420/471 |
| 2-166247 | 6/1990 | Japan . | |

*Primary Examiner*—George Wyszomierski
*Attorney, Agent, or Firm*—Flynn, Thiel, Boutell & Tanis

[57] ABSTRACT

A wear-resistant copper alloy which consists essentially of 56 to 65 wt. % of Cu, 28 to 32 wt. % of Zn, 3.5 to 5.5 wt. % of Al, 0.5 to 2.0 wt. % of Fe, 1.0 to 3.0 wt. % of Ni, 0.1 to 1.0 wt. % of Nb, and 0.4 to 1.5 wt. % of Ti, provided that Ti+Nb is equal to or greater than 0.7 wt. %. The alloy includes two discrete intermetallic compounds comprising Ti-Ni-Fe-Al and Nb-Fe-Al uniformly dispersed in a microstructure preferably including at least 50 volume % beta phase and limited alpha and gamma phases. A synchronizer ring made of the copper alloy is also provided.

8 Claims, 2 Drawing Sheets

WEAR-RESISTANT COPPER ALLOYS AND SYNCHRONIZER RINGS FOR AUTOMOBILES COMPRISING THE SAME

This is a continuation-in-part of parent U.S. application Ser. No. 07/605,957, filed Oct. 30, 1990, now abandoned.

BACKGROUND OF THE INVENTION

1. Field of the Invention

This invention relates to copper alloys and, more particularly, to brass alloys which are useful in various fields requiring good wear resistance. The invention also relates to synchronizer rings for automobiles which comprise the brass alloys of the type mentioned above.

2. Description of the Prior Art

Wear-resistant brass alloys which have been conventionally employed under high speed and high load conditions are those wherein intermetallic compounds, such as $Mn_5Si_3$, precipitate. However, when used under more severe sliding conditions such as operations at high speed and high load with low viscosity oils, the known brass alloys are not satisfactory in practical applications with respect to strength, ductility, and wear resistance. Accordingly, there is a strong demand for brass alloys having better properties.

SUMMARY OF THE INVENTION

It is therefore an object of the invention to provide a wear-resistant copper alloy which can be employed under severe sliding conditions.

It is another object of the invention to provide a wear-resistant copper alloy which has high strength, adequate ductility, and improved wear resistance.

It is a further object of the invention to provide a synchronizer ring which is adapted for use in automobiles and which is comprised of the copper alloy of the type mentioned above.

According to the invention, there is provided a copper alloy which consists essentially of 56 to 65 wt. % of Cu, 28 to 32 wt. % of Zn, 3.5 to 5.5 wt. % of Al, 0.5 to 2.0 wt. % of Fe, 1.0 to 3.0 wt. % of Ni, 0.1 to 1.0 Wt. % of Nb, and 0.4 to 1.5 wt. % of Ti wherein Ti+Nb is equal to or greater than 0.7 wt. % (wt. % is weight %). The alloy is characterized by a matrix microstructure comprising one of alpha+beta phases, beta phase, and beta+gamma phases and comprising, two discrete, relatively hard intermetallic compounds; namely, Ti-Ni-Fe-Al and Nb-Fe-Al intermetallic compounds, uniformly dispersed as precipitates in the matrix.

Preferably, the amount of beta phase in the alloy microstructure is optimized (e.g. at least 50 volume %, preferably at least 70 volume %) and the amount of alpha phase, if any, is limited (e.g. to less than 30 volume %). The amount of gamma phase preferably is limited to 50 volume %.

The present invention also provides a synchronizer ring which comprises the copper alloy defined above.

DETAILED DESCRIPTION OF THE INVENTION

Figure 1:
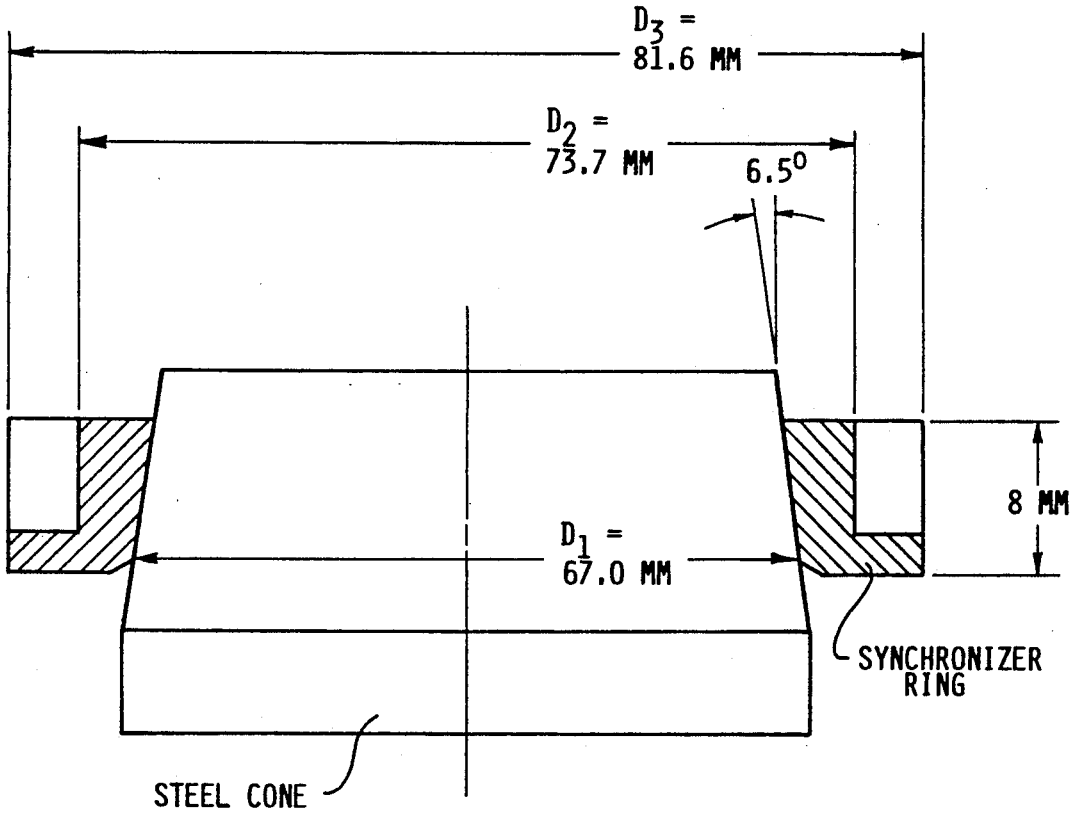
FIG. 1 is a cross-section of the synchronizer ring fabricated in the Example showing the tapered cone used to test wear resistance.
Figure 2:
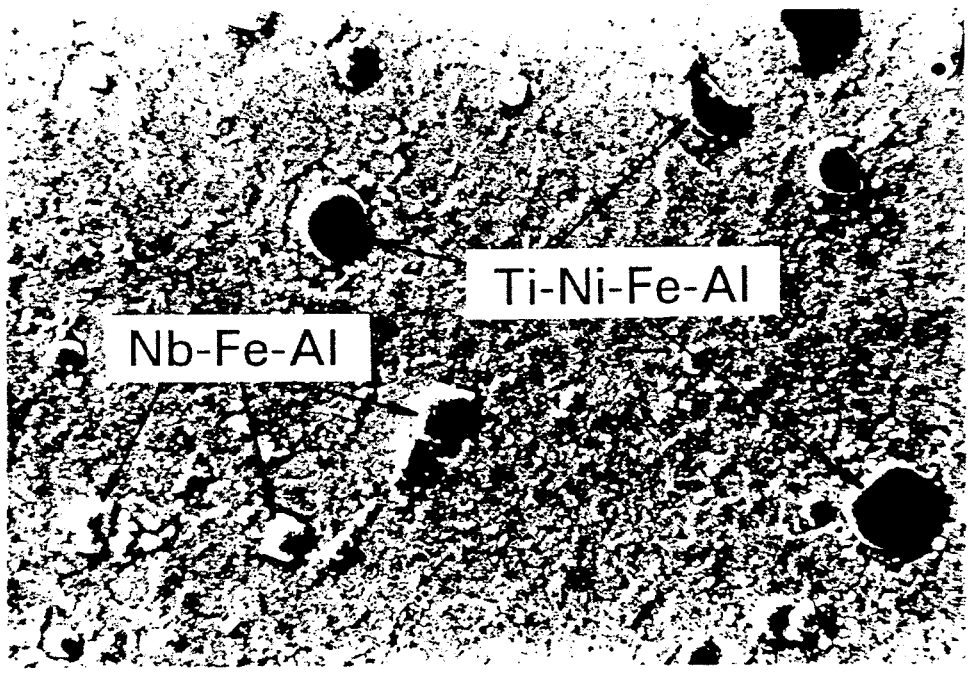
FIG. 2 is a photomicrograph at 1000X of the hot worked microstructure of an alloy of the invention.

The copper alloys of the invention comprise various elements or alloyants in defined compositional ranges for the following reasons:

(a) Zn and Al

In accordance with the invention, Zn is present in the concentration range from about 28 to about 32 weight 10 % Zn, and Al is present in the range from about 3.5 to about 5.5 weight % Al. Within these concentration ranges, the Zn and Al alloyants contribute to improving the wear resistance of the alloy, imparting strength and ductility to the alloy, and achieving, within the Cu concentration range specified below, the desired alloy matrix microstructure having limited, if any, $\alpha$ (alpha) phase or $\gamma$ (gamma) phase and optimized $\beta$ (beta) phase present in the microstructure.

(b) Fe, Ni, Nb, and Ti

The concentration ranges for Fe, Ni, Nb, and Ti are selected to be 0.5 to 2.0 wt. % for Fe, 1.0 to 3.0 wt. % for Ni, 0.1 to 1.o wt. % for Nb, and 0.4 to 1.5 wt. % for Ti. These alloyants are essential for forming intermetallic compounds comprising Ti-Ni-Fe-Al and Nb-Fe-Al as uniformly dispersed precipitates in the matrix having a sufficiently fine (i.e. small) size effective to improve wear resistance of the alloy. If Ti+Nb is less than 0.7 ($Ti+Nb<0.7$) within the Ni and Fe concentration ranges specified above, then the quantity of these intermetallic precipitates present in the matrix is insufficient to achieve improved wear resistance. Thus, in accordance with the invention, Ti+Nb is equal to or greater than 0.7 ($Ti+Nb\geqq 0.7$) within the Fe and Ni ranges set forth to achieve precipitates of fine enough size and uniform dispersion to achieve improved wear resistance.

(c) Pb

Lead is optionally included in the alloy composition for the purpose of imparting improved machinability to the alloy. If the content of Pb is less than 0.1 weight the machinability of the alloy is not significantly improved. Over 3 weight % Pb in the alloy composition results in segregation of Pb in the microstructure with considerable lowering of alloy strength and hot workability. Accordingly, the Pb concentration is 10 maintained in the range from about 0.1 to about 3 weight of the alloy composition.

(d) Cu

Cu is maintained in the range of 56 to 65 weight % of the alloy composition in order to provide a matrix microstructure comprising one of $\alpha+\beta$ phases, $\beta$ single phase, and $\beta+\gamma$ phases wherein the $\beta$ phase preferably is optimized in an amount of at least 50 volume %, preferably at least 70 volume %, of the matrix microstructure while the $\alpha$ and $\gamma$ phases are limited in quantity. In particular, Cu in the range set forth will limit the presence of $\alpha$ (alpha) phase to less than 30 volume %, typically less than 20 volume %, of the matrix microstructure. The presence of $\gamma$ phase is limited to less than 50 volume %, typically less than 30 volume %, in the matrix microstructure. Since the alloys of the invention are shaped to desired configuration by hot working operations, such as for example hot extrusion and hot forging, the matrix microstructure described above relates to the alloy after it is hot worked. The microstructure, however, is determined at room temperature.

EXAMPLE

A series of tests involving alloys of the invention and comparative alloys representative of alloys described in the Smith U.S. Pat. No. 4,418,635 and Giarda et. al., U.S. Pat. No. 4,965,045 were conducted in the manner now described.

Copper alloys having the compositions set forth in Table I were melted and cast to make billets for extrusion.

TABLE I

| | Composition (wt. %) | | | | | | | |
|---|---|---|---|---|---|---|---|---|
| | Cu | Zn | Al | Nb | Ti | Fe | Ni | Pb |
| Inventive Alloys: | | | | | | | | |
| 1 | 64.8 | 28.1 | 4.43 | 0.31 | 0.72 | 0.53 | 1.11 | — |
| 2 | 62.7 | 28.6 | 5.12 | 0.30 | 0.68 | 0.72 | 1.83 | — |
| 3 | 61.5 | 29.8 | 4.47 | 0.28 | 0.73 | 1.12 | 2.04 | — |
| 4 | 60.2 | 31.8 | 3.77 | 0.29 | 0.71 | 1.05 | 2.11 | — |
| 5 | 58.7 | 31.7 | 4.54 | 0.43 | 1.06 | 1.22 | 2.32 | — |
| 6 | 56.8 | 31.8 | 5.32 | 0.72 | 1.31 | 1.19 | 2.81 | — |
| 7 | 61.6 | 29.8 | 4.47 | 0.29 | 0.68 | 0.98 | 1.97 | 0.23 |
| 8 | 59.6 | 30.1 | 4.61 | 0.33 | 0.81 | 0.99 | 2.09 | 1.51 |
| 9 | 59.4 | 29.6 | 4.49 | 0.32 | 0.72 | 0.81 | 1.81 | 2.82 |
| 10 | 64.5 | 28.8 | 3.76 | 0.70 | 0.51 | 0.51 | 1.22 | — |
| 11 | 64.7 | 28.7 | 3.63 | 0.33 | 0.52 | 0.61 | 1.18 | 0.31 |
| 12 | 64.3 | 28.1 | 3.58 | 0.15 | 0.74 | 0.53 | 1.11 | 1.46 |
| 13 | 63.2 | 28.3 | 3.55 | 0.28 | 0.46 | 0.57 | 1.13 | 2.51 |
| 14 | 61.5 | 29.1 | 4.39 | 0.91 | 0.45 | 1.43 | 2.24 | — |
| 15 | 60.8 | 29.9 | 4.63 | 0.17 | 1.41 | 0.63 | 1.73 | 0.73 |
| 16 | 62.8 | 28.3 | 4.91 | 0.53 | 1.12 | 0.37 | 1.94 | — |
| 17 | 60.1 | 31.4 | 4.11 | 0.21 | 0.93 | 0.47 | 2.21 | 0.63 |
| Comparative Alloy A: | | | | | | | | |
| 1 | 66.2 | 28.6 | 1.32 | 0.31 | 0.71 | 0.55 | 2.32 | — |
| 2 | 71.1 | 22.6 | 3.44 | 0.29 | 0.69 | 0.51 | 1.29 | — |
| 3 | 72.4 | 23.0 | 3.37 | 0.33 | 0.27 | 0.28 | 0.34 | — |
| 4 | 78.8 | 15.2 | 4.48 | 0.31 | 0.32 | 0.31 | 0.54 | — |
| 5 | 66.3 | 28.1 | 1.11 | 0.82 | 0.17 | 0.41 | 3.12 | — |
| 6 | 66.4 | 27.7 | 1.24 | 0.17 | 0.21 | 0.24 | 3.97 | — |
| Comparative Alloy B: | | | | | | | | |
| 1 | 63.7 | 34.6 | 1.53 | 0.09 | 0.08 | — | — | — |
| 2 | 67.2 | 30.1 | 2.52 | 0.09 | 0.09 | — | — | — |
| 3 | 69.6 | 27.1 | 3.12 | 0.09 | 0.10 | — | — | — |
| 4 | 74.7 | 21.2 | 3.84 | 0.11 | 0.09 | — | — | — |
| 5 | 76.4 | 17.3 | 5.12 | 0.09 | 0.10 | — | — | — |
| 6 | 84.1 | 8.3 | 7.43 | 0.09 | 0.08 | — | — | — |

Each billet was heated to 730° C. and extruded into an elongated pipe having outer and inner diameters of 80.5 mm and 65.5 mm, respectively. A tensile test specimen was cut from each pipe so that the length of the tensile specimen corresponded to the length direction (extrusion direction) of the pipe and subjected to tensile testing.

For evaluating wear resistance of the alloy compositions of Table I, a ring having a length of 12.4 mm was cut from each pipe. The cut ring was heated to 750° C. and precision forged to obtain a synchronizer ring with a tapered face used for automobile transmissions. The forged ring had a configuration and dimensions as shown in FIG. 1 where diameters D1, D2, D3 are 67.0 mm, 73.7 mm, and 81.6 mm, respectively, the ring axial length is 8 mm, and the ring tapered face angle of 6.5°.

The tapered face of the ring specimen was subjected to a wear resistance test using a tapered cone (6.5° taper) made of a steel material (JIS SCM420H) in a synchronizer ring testing machine. The test conditions involved a ring press load of 60 kgf, a sliding speed of 4.7 m/second, and 2000 press cycles. ATF Dextron fluid was used as a lubricating oil. The degree of dislocation by wear (i.e. a degree of dislocation of the synchronizer ring along the axial direction of the tapered cone) was measured.

The results of the tensile tests and the wear resistance tests are set forth below in Table II.

TABLE II

| | Tensile Strength (kgf/mm2) | Elongation (%) | Wear Loss (μm) | α Phase (vol. %) | β Phase (vol. %) |
|---|---|---|---|---|---|
| Inventive Alloys: | | | | | |
| 1 | 70 | 21 | 330 | 0 | 100 |
| 2 | 76 | 16 | 275 | 0 | 100 |
| 3 | 79 | 15 | 270 | 0 | 100 |
| 4 | 71 | 19 | 280 | 0 | 100 |
| 5 | 75 | 14 | 255 | 0 | 100 |
| 6 | 81 | 11 | 235 | 0 | 100 |
| 7 | 78 | 12 | 290 | 0 | 100 |
| 8 | 72 | 8 | 285 | 0 | 100 |
| 9 | 72 | 5 | 255 | 0 | 100 |
| 10 | 68 | 18 | 300 | 10 | 90 |
| 11 | 67 | 11 | 325 | 10 | 90 |
| 12 | 67 | 10 | 320 | 20 | 80 |
| 13 | 65 | 8 | 315 | 20 | 80 |
| 14 | 80 | 15 | 240 | 0 | 100 |
| 15 | 77 | 15 | 290 | 0 | 100 |
| 16 | 77 | 15 | 260 | 0 | 100 |
| 17 | 74 | 14 | 255 | 0 | 100 |
| Comparative Alloy A: | | | | | |
| 1 | 58 | 39 | 617 | 100 | 0 |
| 2 | 53 | 36 | 853 | 80 | 20 |
| 3 | 52 | 35 | 708 | 80 | 20 |
| 4 | 54 | 32 | 654 | 100 | 0 |
| 5 | 59 | 30 | 550 | 100 | 0 |
| 6 | 58 | 40 | 725 | 100 | 0 |
| Comparative Alloy B: | | | | | |
| 1 | 45 | 43 | 1250 | 70 | 30 |
| 2 | 49 | 37 | 1170 | 90 | 10 |
| 3 | 60 | 30 | 1100 | 100 | 0 |
| 4 | 58 | 28 | 1040 | 100 | 0 |
| 5 | 62 | 15 | 915 | 100 | 0 |
| 6 | 60 | 17 | 875 | 100 | 0 |

The results presented in Table II indicate that the alloys of the invention (alloys 1–17) exhibit substantially improved wear resistance than the comparative alloys (alloy A 1–6 and alloy B 1–6). The average wear loss for the alloys 1–17 of the invention was 281.2 microns. This contrasts to the average wear loss for alloys A and B of 684.5 and 1058.3 microns, respectively.

The Figure is a photomicrograph of the microstructure of alloy #3 of Table I after hot extrusion and hot forging into the synchronizer ring specimen as described above. The microstructure comprises a β phase matrix having the aforementioned two intermetallic compounds precipitated and dispersed uniformly in the matrix. The Ti-Ni-Fe-Al intermetallic compound is relatively rich in Ti, Ni, and Fe (i.e. each of these elements is present in an amount greater than 20 weight %) as is apparent from Table III below. The Nb-Fe-Al intermetallic compound is relatively rich in Nb and Fe (i.e. Nb and Fe each is present in an amount of greater than 30 weight %) as also apparent from Table III. The atomic %'s of the elemental constituents of the intermetallic compounds were determined by electron probe (X-ray) microanalyzer.

TABLE III

| | Ti—Ni—Fe—Al System | | Nb—Fe—Al System | |
|---|---|---|---|---|
| Element | wt. % | at. % | wt. % | at. % |
| Ti | 20.1 | 20.8 | 3.8 | 4.6 |
| Ni | 25.6 | 21.6 | 5.6 | 5.6 |
| Fe | 20.3 | 18.0 | 34.7 | 37.4 |
| Al | 13.3 | 24.5 | 8.5 | 19.3 |
| Nb | 4.6 | 2.5 | 39.4 | 25.7 |

TABLE III-continued

| | Ti—Ni—Fe—Al System | | Nb—Fe—Al System | |
|---|---|---|---|---|
| Element | wt. % | at. % | wt. % | at. % |
| Cu | 16.0 | 12.6 | 8.0 | 7.4 |

The Ti-Ni-Fe-Al intermetallic precipitates have a relatively round morphology and are larger in size than the Nb-Fe-Al intermetallic precipitates, which are blocky and smaller in size. The hardness of the Ti-Ni-Fe-Al intermetallic precipitates was measured to be in the range of 600 to 650 Vickers microhardness (using 10 grams weight) as compared to a hardness of 1100 to 1150 Vickers microhardness (10 grams weight) for the Nb-Fe-Al intermetallic precipitates. These hardness values are much higher than typical hardness values of 150, 200, and 500 Vickers microhardness exhibited by the $\alpha$, $\beta$ and $\gamma$ phases, respectively.

The intermetallic precipitates described above and the matrix microstructure having limited, if any, alpha and gamma phase present and optimized amounts of beta phase are believed responsible for the improved wear resistance of the alloys of the invention evident from Table II.

While the invention has been described in terms of 10 specific embodiments thereof, it is not intended to be limited thereto but rather only to the extent set forth in the following claims.

The embodiments of the invention in which an exclusive property or privilege is claimed are defined as follows:

1. A wear-resistant copper alloy consisting essentially of 56 to 65 wt. % of Cu, 28 to 32 wt. % of Zn, 3.5 to 5.5 wt. % of Al, 0.5 to 2.0 wt. % of Fe, 1.0 to 3.0 wt. % of Ni, 0.1 to 1.0 wt. % of Nb, and 0.4 to 1.5 wt. % of Ti wherein Ti+Nb is equal to or greater than 0.7 wt. %, and wherein said alloy includes two discrete intermetallic compounds dispersed as precipitates in the microstructure, a first of said compounds comprising Ti-Ni-Fe-Al and a second of said compounds comprising Nb-Fe-Al.

2. The wear-resistant copper alloy according to claim 1 wherein said alloy has a microstructure comprising one of alpha+beta phases, beta phase, and beta+-gamma phases.

3. The wear-resistant copper alloy according to claim 2 wherein beta phase is present in an amount of at least 50 volume % of the microstructure.

4. The wear-resistant copper alloy of claim 2 wherein alpha phase, if present, is less than 30 volume of the microstructure.

5. The wear-resistant copper alloy according to claim 1 further comprising 0.1 to 3 wt. % of Pb.

6. A synchronizing ring for an automobile transmission comprising the wear-resistant copper alloy of claim 1.

7. A synchronizing ring for an automobile transmission comprising the wear-resistant copper alloy of claim 2.

8. A synchronizing ring for an automobile transmission comprising the wear-resistant copper alloy of claim 5.

* * * * *

UNITED STATES PATENT AND TRADEMARK OFFICE

CERTIFICATE OF CORRECTION

PATENT NO. : 5 288 683

DATED : February 22, 1994

INVENTOR(S) : Kunio NAKASHIMA et al

It is certified that error appears in the above-identified patent and that said Letters Patent is hereby corrected as shown below:

Column 6, line 19; after "volume" insert ---%---.

Signed and Sealed this

Fifth Day of July, 1994

Bruce Lehman

*Attest:*

BRUCE LEHMAN

*Attesting Officer*

*Commissioner of Patents and Trademarks*